US009404345B2

(12) United States Patent
Fieler et al.

(10) Patent No.: US 9,404,345 B2
(45) Date of Patent: Aug. 2, 2016

(54) SUBSEA SOUR GAS AND/OR ACID GAS INJECTION SYSTEMS AND METHODS

(75) Inventors: Eleanor Fieler, Conroe, TX (US); Peter C. Rasmussen, Navarre, FL (US); Chris M. Robinson, San Ramon, CA (US); Douglas W. Hissong, Cypress, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 364 days.

(21) Appl. No.: 14/123,952

(22) PCT Filed: May 24, 2012

(86) PCT No.: PCT/US2012/039442

§ 371 (c)(1),
(2), (4) Date: Dec. 4, 2013

(87) PCT Pub. No.: WO2013/006232

PCT Pub. Date: Jan. 10, 2013

(65) Prior Publication Data

US 2014/0131047 A1 May 15, 2014

Related U.S. Application Data

(60) Provisional application No. 61/503,986, filed on Jul. 1, 2011.

(51) Int. Cl.

| | |
|---|---|
| ***E21B 41/00*** | (2006.01) |
| ***E21B 43/16*** | (2006.01) |
| ***E21B 43/40*** | (2006.01) |

(52) U.S. Cl.

CPC ..... *E21B 41/0092* (2013.01); *E21B 43/168* (2013.01); *E21B 43/40* (2013.01)

(58) Field of Classification Search

CPC .... E21B 41/0092; E21B 43/168; E21B 43/40
See application file for complete search history.

(56) References Cited

U.S. PATENT DOCUMENTS

| | | | | |
|---|---|---|---|---|
| 4,336,843 A | 6/1982 | Petty | ..... | 166/362 |
| 5,390,743 A * | 2/1995 | Giannesini | ..... | E21B 43/40 166/352 |

(Continued)

FOREIGN PATENT DOCUMENTS

| | | | | |
|---|---|---|---|---|
| WO | WO2006/132541 | 12/2006 | ..... | E21B 43/01 |
| WO | WO2010/039317 | 4/2010 | ..... | E21B 47/00 |

OTHER PUBLICATIONS

Northrop, P. S. (2004), "Cryogenic Sour Gas Process Attractive for Acid Gas Injection Applications," *Proceedings Annual Convention—Gas Processors Association*, Mar. 14, 2004, pp. 1-8.

(Continued)

*Primary Examiner* — Matthew R Buck
(74) *Attorney, Agent, or Firm* — ExxonMobil Upstream Research Company Law Department

(57) ABSTRACT

A hydrocarbon processing method, including processing a gaseous hydrocarbon stream to form a first production stream and a first injection stream; and compressing the first injection stream in a compressor placed at a selected location below a surface of a sea; wherein the location of the subsea compressor relative to a nearest inhabited area is determined based on a bubble plume trajectory of a model leak of the first injection stream from the compressor; and wherein the bubble plume trajectory is determined using one or more crossflow momentum parameters is disclosed herein. Also disclosed are hydrocarbon processing facilities having subsea compressors placed at such selected locations, processes for designing such hydrocarbon processing facilities, and a mathematical model useful in such methods, processes, and facilities.

31 Claims, 10 Drawing Sheets

(56) References Cited

U.S. PATENT DOCUMENTS 6,632,266 B2 * 10/2003 Thomas ..... B01D 53/22 95/49
6,755,251 B2 * 6/2004 Thomas ..... E21B 41/0064 166/227
7,128,150 B2 * 10/2006 Thomas ..... E21B 41/0064 166/265
8,479,833 B2 * 7/2013 Raman ..... E21B 43/164 166/402
8,733,459 B2 * 5/2014 Wallace ..... E21B 41/0064 166/402
2005/0072574 A1 * 4/2005 Appleford ..... E21B 43/017 166/366
2010/0186586 A1 * 7/2010 Chinn ..... B01D 53/22 95/45
2010/0307765 A1 * 12/2010 van Arkel ..... E21B 43/122 166/372

OTHER PUBLICATIONS

PCT International Search and Written Opinion dated Aug. 31, 2012, 7 pages.

* cited by examiner

SUBSEA SOUR GAS AND/OR ACID GAS INJECTION SYSTEMS AND METHODS

CROSS-REFERENCE TO RELATED APPLICATIONS

This application is the National Stage of International Application No. PCT/US2012/039442, filed on May 24, 2012, claims the benefit of U.S. provisional patent application No. 61/503,986 filed on Jul. 1, 2011 entitled SUBSEA SOUR GAS AND/OR ACID GAS INJECTION SYSTEMS AND METHODS, the entirety of which is incorporated herein by reference for all purposes.

FIELD OF THE DISCLOSURE

Embodiments of the disclosure relate to subsea acid gas compression. More particularly, embodiments of the present disclosure relate to processes and systems using subsea acid gas compressors.

BACKGROUND OF THE DISCLOSURE

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Many gas streams, for example natural gas, contain large amounts of acid gases that must be separated from the more valuable components in the gas. Natural gas from well production is used extensively as fuel and as a basic raw material in the petrochemical and other chemical process industries. While the composition of natural gas can vary widely from field to field, many natural gas reservoirs contain relatively low percentages of hydrocarbons (less than 40%, for example) and high percentages of acid gases, principally carbon dioxide, but also hydrogen sulfide, carbonyl sulfide, carbon disulfide, and various mercaptans. Sour gas is a mixture containing hydrogen sulfide, carbon dioxide, and hydrocarbons. Removal of the acid gases from sour gas is desirable to provide conditioned or "sweet" dry natural gas for delivery to a pipeline, natural gas liquids recovery, helium recovery, conversion to liquid natural gas, or nitrogen rejection.

The separated acid gases are available for processing, sequestration, disposal, or for further use. The acid gases have, for example, been reinjected into a subterranean formation for disposal and into hydrocarbon-bearing formations for hydrocarbon recovery. Acid gas injection (AGI) and sour gas injection (SGI) have been practiced for more than 15 years in onshore applications. Compression and pumping technology may include flows ranging from less than 1 Mscf/d to more than 80 Mscf/d. Pressures range up to 3,200 psi at the surface. The machinery utilized in AGI can be reciprocating compressors, centrifugal compressors and dense phase centrifugal or reciprocating pumps. Pumps are sometimes also combined with compressors to achieve higher injection pressures.

Reciprocating and centrifugal compressors have also been used to compress gas containing hydrogen sulfide for sales or injection, both onshore and offshore. Some reciprocating sales gas compressors have been used commercially to compress gas containing up to 1% hydrogen sulfide. In some cases, centrifugal compressors have been used commercially to inject gas containing approximately 5% hydrogen sulfide.

Both of these examples utilize gas derived directly from production without an $H_2S$ removal process.

Additional information relating to the field of the invention can be found in: P. S. Northrop et al., "Cryogenic Sour Gas Process Attractive for Acid Gas Injection Applications," Proceedings Annual Convention—Gas Processors Association, 14 Mar. 2004, pp. 1-8; International Patent Application No. WO 2006/132541; and U.S. Pat. No. 6,632,266.

Compression of acid and sour gases in an offshore environment has the potential to make new offshore fields viable. However, offshore platforms place unique constraints on the flexibility of operating in any compromised environment. There are limited opportunities for refuge or escape should the atmosphere contain harmful or flammable gases that have been released from the compressor or compression system. This is particularly true in the case of reciprocating compressors which exhibit sudden massive releases of sour gas in certain failure modes. There is a present need to decrease the health and regulatory risks and environmental damage due to unexpected release of acid gases from offshore acid gas compression. There is also a need for processes and systems that optimize the placement of a subsea compressor to further reduce the health and regulatory risks and environmental damage due to unexpected release of acid gases from subsea acid gas compression.

SUMMARY OF THE DISCLOSURE

The present disclosure relates to hydrocarbon processing methods comprising processing a gaseous hydrocarbon stream to form a first production stream and a first injection stream; and compressing the first injection stream in a compressor placed at a selected location below a surface of a sea; wherein the location of the subsea compressor relative to a nearest inhabited area is determined based on a bubble plume trajectory of a model leak of the first injection stream from the compressor; and wherein the bubble plume trajectory is determined using one or more cross flow momentum parameters.

The present disclosure further relates to hydrocarbon processing facilities, comprising a gas processing system configured to receive and process a gaseous hydrocarbon stream to produce at least one injection gas stream and at least one production gas stream; an acid gas injection system comprising a compressor, configured to compress and inject the at least one injection gas stream, the compressor being placed at a selected location below the surface of a sea; wherein the location of the subsea compressor relative to a nearest inhabited area is determined based on a bubble plume trajectory of a model leak of the first injection stream from the compressor; and wherein the bubble plume trajectory is determined using one or more cross flow momentum parameters.

The present disclosure yet further relates to processes for designing an integrated hydrocarbon gas processing facility, comprising providing an offshore production platform having an inhabited area; providing at least one gas sweetening unit located on the offshore production platform; wherein the at least one gas sweetening unit is in fluid communication with at least one liquid separation unit and at least one subsea compressor unit; and determining a selected location of the subsea compressor relative to a nearest inhabited area; wherein the determination is based on a bubble plume trajectory of a model leak from the compressor; and optimizing the time a leak from the subsea compressor takes to reach the inhabited area.

The present disclosure also relates to a mathematical model for the prediction of the trajectory of subsea leaks, wherein the model predicts a bubble plume trajectory of one or more subsea leaks based on at least one or more cross flow momentum parameters.

BRIEF DESCRIPTION OF THE DRAWINGS

The foregoing and other advantages of the present disclosure may become apparent upon reviewing the following detailed description and drawings of non-limiting examples of embodiments in which.

DETAILED DESCRIPTION OF THE DISCLOSURE

Figure 1:
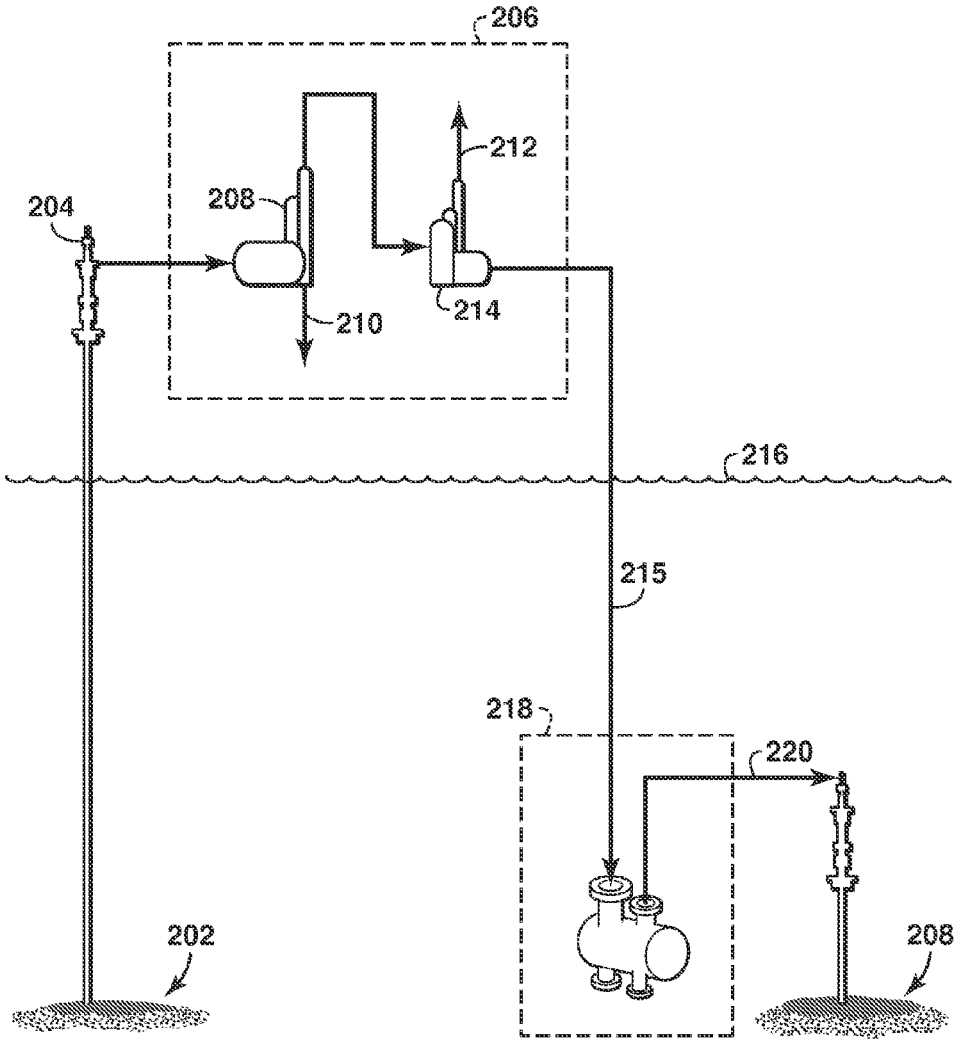
FIG. 1 shows a representative hydrocarbon processing facility of the present disclosure.

In the following detailed description section, the specific embodiments of the present disclosure are described in connection with preferred embodiments. However, to the extent that the following description is specific to a particular embodiment or a particular use of the present disclosure, this is intended to be for exemplary purposes only and simply provides a description of the exemplary embodiments. Accordingly, the disclosure is not limited to the specific embodiments described below, but rather, it includes all alternatives, modifications, and equivalents falling within the true spirit and scope of the appended claims.

Various terms as used herein are defined below. To the extent a term used in a claim is not defined below, it should be given the broadest definition persons in the pertinent art have given that term as reflected in at least one printed publication or issued patent.

As used herein, the term "natural gas" refers to a multi-component gas obtained from a crude oil well (associated gas) or from a subterranean gas-bearing formation (non-associated gas). The composition and pressure of natural gas can vary significantly. A typical natural gas stream contains methane ($CH_4$) as a major component. The natural gas stream can also contain ethane ($C_2H_6$), higher molecular weight hydrocarbons (e.g., $C_3$-$C_{20}$ hydrocarbons), one or more acid gases (e.g., hydrogen sulfide, carbon dioxide), or any combination thereof. The natural gas can also contain minor amounts of contaminants such as water, nitrogen, iron sulfide, wax, crude oil, or any combination thereof.

Acid gases are contaminants that are often encountered in natural gas streams. Typically, these gases include carbon dioxide and hydrogen sulfide, although any number of other contaminants may also form acids. Acid gases are commonly removed by contacting the gas stream with an absorbent liquid, which may react with the acid gas. When the absorbent liquid becomes acid-gas "rich", a desorption step can be used to separate the acid gases from the absorbent liquid. The "lean" absorbent liquid is then typically recycled for further absorption.

The term "acid gas" means any one or more of carbon dioxide ($CO_2$), hydrogen sulfide ($H_2S$), carbon disulfide ($CS_2$), carbonyl sulfide (COS), mercaptans (R—SH, where R is an alkyl group having 1 to 20 carbon atoms), sulfur dioxide ($SO_2$), combinations thereof, mixtures thereof, and derivatives thereof.

The term "sour gas" means a gas containing undesirable quantities of acid gas, e.g., 55 parts-per-million by volume (ppmv) or more, or 500 ppmv, or 5 percent by volume or more, or 15 percent by volume or more, or 35 percent by volume or more. At least one example of a "sour gas" is a gas having from about 2 percent by volume or more to about 7 percent by volume or more of acid gas.

An "acid gas removal unit" broadly refers to any suitable device and/or equipment to separate at least a portion of an acid gas stream from another process stream, such as a hydrogen stream. Acid gas broadly refers to a gas and/or vapor that contains hydrogen sulfide, carbon dioxide, other similar contaminants, and/or the like. Desirably, the acid gas removal unit can separate and/or form a hydrogen stream or a purified syngas stream, and an acid gas stream. The acid gas removal unit may also separate the acid gas stream into one or more components and/or constituents, such as into a carbon dioxide stream and a hydrogen sulfide stream. The acid gas removal unit may include any suitable device and/or equipment, such as pumps, valves, pipes, compressors, heat exchangers, pressure vessels, distillation columns, control systems, and/or the like. According to one embodiment, the acid gas removal unit includes one or more absorber towers and one or more stripper towers. The acid gas removal unit may recover and/or separate any suitable amount of acid gas from a process stream, such as at least about 50 percent, at least about 75 percent, at least about 85 percent, at least about 90 percent, at least about 95 percent, at least about 99 percent, and/or the like on a mass basis, a volume basis, a mole basis, and/or the like. The acid gas removal unit may include Rectisol® systems from Linde AG, Munich, Germany, and/or Lurgi GmbH, Frankfurt, Germany, methanol systems, alcohol systems, amine systems, promoted amine systems, hindered amine systems, glycol systems, ether systems, potassium carbonate systems, water scrubbing systems, other suitable solvents, and/or the like.

The term "sweet gas" means a gas having no more than the maximum sulfur content defined by the specifications for the sales gas from a plant or the definition by a legal body, such as the Texas Railroad Commission. The term "sweet gas" includes a gas having no objectionable sulfur compounds, such as less than 21 ppmv of "sulfur-containing compounds" (measured as sulfur), for example, and no objectionable amount of carbon dioxide. For example, sweet gas has a maximum quantity of carbon dioxide such as less than 2% by volume for pipeline sales gas and 50 ppmv for Liquefied Natural Gas (LNG) manufacturing.

"Subsea" is intended to encompass both salt water and fresh water environments, and represents the region between the water surface and the bed of the body of water.

A subsea compressor may comprise any one type or combination of similar or different types of compression equipment, and may include auxiliary equipment, known in the art for compressing a substance or mixture of substances. A "compression unit" may utilize one or more compression stages. Illustrative compressors may include, but are not limited to, positive displacement types, such as reciprocating and rotary compressors for example, and dynamic types, such as centrifugal and axial flow compressors, for example.

Embodiments herein relate to methods and facilities comprising subsea gas compressors. Embodiments of the presently disclosed methods and facilities may be used to reduce the health and regulatory risks of offshore hydrocarbon production operations. In particular, embodiments herein may reduce the risk of exposure of offshore workers to hazardous releases of acid and/or sour gases.

Conventional offshore processing often includes separation, compression, gas sweetening, gas dehydration, gas dewpointing, condensate stabilization and/or produced water treatment. Very often, the gas compression station is located on the production platform. In the event of an unexpected release of acid and/or sour gases, the small footprint of the production platform results in toxic gases traversing the workers' area quite rapidly. This allows little time to don respirators or breathing air or to seek a refuge from the dispersing gas cloud. Options to reduce the risk of exposure to hazardous release of acid/sour gases in offshore include locating the gas compression station either on a remote uninhabited platform, or subsea, either remotely on the sea bed or attached to a support structure which is further attached to the production platform.

Of these options, subsea gas compression technology is particularly attractive due to the comparatively lower cost and improved regulatory considerations. Advantageously, leaks from gas compression stations located subsea take time to rise to the surface of the sea. When the gas is released into water, the water, due to its density and viscosity, serves as a "momentum brake" to the dispersion of the toxic gases, slowing their spread relative to dispersion of a gas release into air. In other words, the water provides much more resistance to flow of the released gas than does air. The gas therefore leaves the water surface at a velocity much lower than the release velocity, such that it is readily swept away by wind.

The inventors have developed a bubble plume model such that the location of the source of an unplanned release may be correlated to subsequent bubble plume rise and dispersion. Embodiments herein relate to a mathematical model for the prediction of the trajectory of subsea leaks, wherein the model predicts a bubble plume trajectory of one or more subsea leaks based on at least one or more cross flow momentum parameters and the use thereof. This model advantageously allows the optimal placement of acid/sour gas compressors subsea in order to maximize the time available before the bubble plume rises to the surface, and/or the plume location at the surface.

In particular, some embodiments herein relate to a hydrocarbon processing method, comprising processing a gaseous hydrocarbon stream to form a first production stream and a first injection stream; and compressing the first injection stream in a compressor placed at a selected location below a surface of a sea; wherein the location of the subsea compressor relative to a nearest inhabited area is determined based on a bubble plume trajectory of a model leak of the first injection stream from the compressor; and wherein the bubble plume trajectory is determined using one or more cross flow momentum parameters.

Additionally, embodiments herein relate to a hydrocarbon processing facility, comprising a gas processing system configured to receive and process a gaseous hydrocarbon stream to produce at least one injection gas stream and at least one production gas stream; an acid gas injection system comprising a compressor, configured to compress and inject the at least one injection gas stream, the compressor being placed at a selected location below the surface of a sea; wherein the location of the subsea compressor relative to a nearest inhabited area is determined based on a bubble plume trajectory of a model leak of the first injection stream from the compressor; and wherein the bubble plume trajectory is determined using one or more crossflow momentum parameters.

Even further, embodiments herein relate to a process for designing an integrated hydrocarbon gas processing facility, comprising providing an offshore production platform having an inhabited area; providing at least one gas sweetening unit located on the offshore production platform; wherein the at least one gas sweetening unit is in fluid communication with at least one liquid separation unit and at least one subsea compressor unit; and determining a selected location of the subsea compressor relative to a nearest inhabited area; wherein the determination is based on a bubble plume trajectory of a model leak from the compressor; and optimizing the time a leak of gas from the subsea compressor takes to reach the inhabited area.

FIG. 1 shows a representative hydrocarbon processing facility of the present disclosure. The hydrocarbon producing facility is typically located offshore. It is also within the scope of this disclosure to have the producing and processing steps occur onshore and the compression of the waste gas occur offshore. In some embodiments, the producing steps occur on a production platform 206. In embodiments herein, the production platform may be fixed or floating.

A producing well 202 is located below the surface of a sea 216. The production platform 206 consist of production equipment 204, 208, and 214 that control well fluids and separate gas and liquids. The separated liquids 210 are typically used for sales. This facility also processes some or all of the gas to remove toxic and corrosive compounds such as $H_2S$ and $CO_2$ using conventional gas sweetening processes and equipment 214. The sweetened gas 212 can be used for either for sales or fuel. The resulting waste stream 215 is typically at low pressures and is fed to a compressor 218 located below the water surface 216.

The compressor 218 is a motor driven, hermetically sealed compressor capable of compressing acid gas to high enough pressure to provide a compressed gas stream to be directly pumped 220 to an injection well(s) 208 for either disposal or enhanced oil recovery. In some embodiments, the producing and/or processing steps occur at an offshore platform.

Embodiments herein require a subsea gas compressor. In some embodiments, a centrifugal gas compressor useful for subsea applications is used. Such a compressor is driven with a motor either directly or through a gear. Sometimes, high speed motors (>6,200 rpm) are used to achieve required compressor speeds. These compressors often require a variable frequency drive (VFD) to achieve speeds above synchronous (3,000 or 3,600 rpm), and are designed to compress the gas from well stream fluids for transfer to remote processing facilities for injection. Subsea compression requires the motor, VFD (if located subsea), and compressor to be hermetically sealed to contain the compressed gas and to protect the motor and compressor from the sea environment. Subsea compression also requires an electrical power source supplied to the compressor. It also requires that the gas path also has to be designed with materials suitable for wet, sour service. Pilot tests using subsea compressors made by General Electric are currently in progress.

When an unplanned release of acid/sour gas occurs from a subsea compressor, the released gas will tend to form a plume that rises to the water surface. As used herein, "bubble plume," "gas plume," or "plume" refers to the released gas as it rises through the water. The bubble plume may be described in terms of its diameter, velocity, and the plume location at the surface. These bubble plume characteristics are shown in FIG. 2 and described in turn below.

Figure 2:
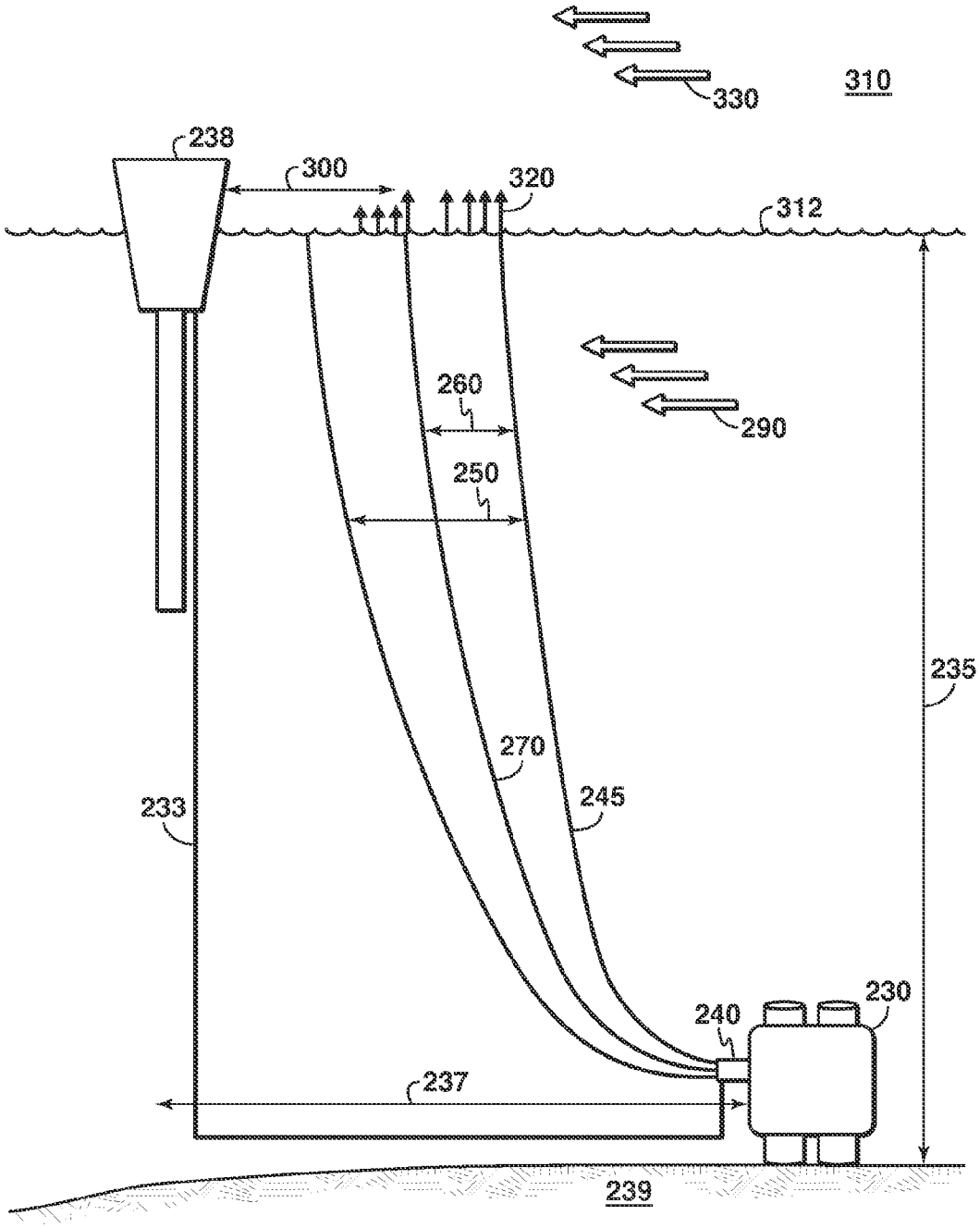
FIG. 2 shows a schematic of an unplanned acid/sour gas release from a subsea gas compressor.

FIG. 2 is a schematic of a leak from a subsea compressor, and is not drawn to scale. FIG. 2 shows a subsea compressor 230 located at a depth 235 below the surface of a sea, and at a horizontal distance 237 from a facility having inhabited areas 238. The subsea compressor may be placed at any suitable depth 235. The maximum depth at which the subsea compressor may be placed is typically limited by the depth of the sea floor 239. In some embodiments, the subsea compressor is located at a depth of 300 meters (928 feet) or greater (alternately 500 meters or greater, alternately 1500 meters or greater, alternately 3000 meters or greater or alternately 4500 meters or greater). In some embodiments, the subsea compressor is located at one of the sea floor and a support structure fixedly attached to the offshore platform. In preferred embodiments, the subsea compressor is located on the sea floor.

The subsea compressor may also be laterally displaced from the platform and any inhabited areas by a horizontal distance 237. The extent of this lateral displacement is a noteworthy design parameter of the bubble plume model disclosed herein. As the horizontal distance from the inhabited areas increases, there is typically a tradeoff between decreased risk and increased economic investment. As the horizontal distance 237 increases, the length of larger piping transporting the gas to the compressor increases. This will increase the costs of the facility. The use of the bubble plume model to optimize the lateral distance may advantageously enable the maximization of reduced risk while conserving the economic investment. In some embodiments, the subsea compressor is located at a horizontal distance of about 300 meters or more from the inhabited areas 238. In other embodiments, the subsea compressor is located at a horizontal distance of about 500 meters or more from the inhabited area (alternately, from about 1500 meters or more).

The subsea compressor compresses a first injection stream 233 from the facility. In some embodiments, the first injection stream is one of an acid gas stream or a sour gas stream. In an unplanned release, a leak may occur at a point of release, for example, 240. Gases will then escape and form a bubble plume 245, which will then rise to the surface of the sea or the waterline. Placing the gas compressor subsea thus advantageously allows for dispersion of gases in water in the event of a leak. In the absence of oxygen, there is little or no risk of fire or explosion subsea. Furthermore, as the gases rise through the water column in the form a plume, the gases disperse through the water, resulting in a widening of the plume as the gases approach the waterline. When the gases are released at the waterline into the atmosphere, they are already diluted by dispersion, thereby providing a lower risk of fire and explosion at the surface due to compressor leakage subsea.

The bubble plume may be described by one or more of plume rise time, waterline gas velocity, and waterline plume radius. Additionally, the bubble plume trajectory may determined by one or more of the pressure of the conduit having the leak, the depth of the sea, the horizontal distance of the subsea compressor from the inhabited area, the salinity of the sea, the temperature of the water, the density of the components of the first injection stream, the velocity of the water currents, and the leak diameter.

The plume radius at any point is the distance from the plume centerline 270 to the edge of the plume, and is typically measured perpendicular to the plume centerline. The plume radius at the surface is known as the waterline plume radius. As used herein, the plume diameter is the width of the plume at a particular point, and typically is about twice the plume radius at that point. A plume may have a plume diameter near the point of release 240, and a different plume diameter at the surface of the sea (or waterline) 312. The diameter at the surface is known as the waterline plume diameter. With respect to FIG. 2, a plume diameter is shown as 250. A plume radius is shown as 260. The plume diameter of the released gas may depend on several factors. For example, the released gas may expand as it rises due to a decrease in hydrostatic pressure. Additionally, if the released gas comprises any liquid hydrocarbons, these liquid hydrocarbons may vaporize as the gas rises due to the decrease in hydrostatic pressure. This expansion often leads to an increase in plume diameter. Vaporization of any liquids and consequently plume diameter expansion may be also be affected by the water temperature, which normally increases on moving upward through the water column. Furthermore, as the plume rises through the water, water may become entrained therein, also typically contributing to an increase in plume diameter.

The time a gas takes to travel from the point of the subsea release 240 to the surface of the sea 312 is known as the plume rise time. In embodiments herein, the subsea compressor is placed at a depth to maximize the plume rise time. The plume rise time increases with increasing leak depth and increasing water current. In some embodiments, the plume rise time is greater than about 2.0 minutes (preferably greater than about 10 minutes).

The plume may be moved and/or distorted by crossflow momentum. As used herein, "crossflow momentum" means the forces due to water current that tend to move the plume sideways, or forces due to plume buoyancy that tend to move the plume upwards. In embodiments herein, the crossflow momentum parameter includes terms for current 290 and/or buoyancy effects. The crossflow momentum may vary at any point throughout the plume. This movement or distortion of the plume will usually affect the plume location at the surface, relative to the facility, also called the waterline plume location, 300. The waterline plume location is important because an inhabited area may be present at or near to that location.

On reaching the water surface 312, the gas leaving the plume will disperse into the air 310 at a certain velocity 320. The velocity of the gas as it emerges from the surface of the water is known as the waterline gas velocity. The bubble plume model predicts the waterline gas velocity which can be used in atmospheric dispersion predictions that may aid in optimal location of the subsea gas compressor. In most embodiments, the waterline gas velocity will be less than 2 meters/second). The wind velocity and the direction that the wind blows at the location at which the plume emerges are also important, because they also affect the atmospheric dispersion of the gas. In the worst case scenario, the wind currents may blow the emerging plume directly towards the inhabited areas 330.

The time required for the gas to rise to the surface of the water represents additional time for personnel to react, mitigate the event, and protect themselves. Placing the subsea compressor at a certain depth below the surface of the sea moves the gas plume farther from the facility, thereby providing more vertical distance for the gas plume to travel. This increased vertical distance that the gas is forced to travel provides valuable response time for personnel. Any increase obtained in the time between the instance of gas release and the diffusion of the released gas from sea to the atmosphere is invaluable in terms of reducing industrial and health risks. Accordingly, optimal placement of a subsea gas compression system requires taking advantage of any factors that increase this response time in the event of an unplanned release of acid/sour gas from the compressor.

Additional considerations may include horizontal distance of the gas compression system from the drilling platform, in particular any inhabited area, for example, the living quarters. Placing the subsea compressor at a location horizontally displaced from the facility allows the location of the waterline gas plume from an unplanned leak to be at surface location which is a certain distance away from the facility. This allows additional dilution of the toxic gases with air. This reduces toxic gas concentrations where personnel are and again provides additional time for the personnel to react. Locating the gas compression station subsea at a certain horizontal distance from the facility may therefore provide critical additional time for personnel response in the case of an unexpected sour and/or acid gas leak.

Furthermore, the waterline plume radius is of great importance in optimal placement of a subsea compression station. The larger the waterline plume radius, the lower the waterline gas velocity. However, a too large waterline plume radius may be undesirable due to the large surface area of gas release to the atmosphere. Accordingly, the benefits of decreased waterline gas velocity should be balanced against the surface area available for gas release to the atmosphere.

Other factors that may influence optimal placement of a subsea gas compression station include depth of the ocean floor, salinity and/or buoyancy, proximity to other subsea operations such as drilling, meteorological conditions such as wind velocities, oceanographical conditions such as ocean floor topography and prevailing ocean currents, the $H_2S$ partial pressure of the acid/sour gas, and leak size assumptions.

Optimal placement of the subsea compressor at a location subsea may be achieved using a predictive tool in the form of the bubble plume model described herein. The inventors have advantageously developed a bubble plume model which is used to simulate physical properties of an unplanned subsea release. The model advantageously executes very rapidly on personal computers. The program first integrates downward from the water surface to the release location to calculate the hydrostatic backpressure at the release location, accounting for variation of the water (generally seawater) density with temperature. The temperature profile through the water column is specified. Seawater density is calculated from salinity. From the specified temperature and pressure at the release location (obtained from a release model), the program calculates the fluid velocity at the release location, which is generally the sonic velocity at those conditions. This provides the initial velocity for the plume calculations. For the plume calculations, the program integrates upward from the release location to the water surface.

The model involves solving the following differential equations: mass conservation, including entrainment of water into the plume and conservation of momentum in the axial and crossflow directions. The release can be oriented at any angle in a plane aligned with the current. The velocity with which water is entrained into the plume is related to the axial velocity of the plume, based on experimental data. At each position along the plume axis, the buoyancy and current forces are resolved into axial and crossflow components. The current and water temperature can vary with water depth, as the user can input a table of values for interpolation.

A "tophat" (sharp-edged) profile for velocity and gas fraction has been assumed in the cross-plume direction. Plume velocity and gas fraction are assumed uniform from the plume centerline to the plume radius (b), i.e., the plume edge. At that point, the plume velocity (U) drops discontinuously to the external current velocity ($U_w$), and the gas mass fraction ($f_g$) drops discontinuously to zero. Differential equations for conservation of both gas and liquid mass and momentum are written in the plume axis direction, denoted by s. Assuming overall mass conservation yields Equation 1, below.

$$\frac{d}{ds}(b^2\rho_p U) = 2\rho_w b\alpha U\left(1 - \frac{U_w}{U}\sin\theta\right) \tag{1}$$

where:

s is the coordinate directed along the local plume axis;

b is the plume radius;

$\rho_p$ is the density of the plume;

U is the plume axial velocity;

$\rho_w$ is the density of the surrounding water;

$\alpha$ is the entrainment coefficient;

$U_w$ is the horizontal velocity of the surrounding water; and $\theta$ is the local angle of the plume axis from vertical.

Entrainment of the external fluid, such as the sea water, into the plume is specified through an entrainment factor, $\alpha$. The entrainment factor is the ratio of the radial velocity of the external fluid into the plume to the axial velocity of the plume at that point. Assuming a hydrostatic pressure variation imposed by the surrounding fluid, overall conservation of momentum in the axial direction yields Equation 2, below.

$$2U^2\rho_w b\alpha\left(1 - \frac{U_w}{U}\sin\theta\right) + (b^2\rho_p U)\frac{dU}{ds} = b^2 g\cos\theta(\rho_w - \rho_p) \tag{2}$$

where g is the acceleration due to gravity.

Assuming no vapor-liquid phase transfer, gas mass is conserved, which yields Equation 3, below.

$$\frac{d}{ds}(b^2 U f_g \rho_g) = 0 \tag{3}$$

where $f_g$ is the gas mass fraction in the plume; and $\rho_g$ is the density of the gas.

The equation for conservation of crossflow momentum includes terms for the current and buoyancy effects, as shown below in Equation 4:

$$\frac{d\theta}{ds} = \underbrace{\frac{C_d}{\pi b}\frac{\rho_w}{\rho_p}\left(\frac{U_w}{U}\right)^2\cos\theta}_{\text{Current}} - \underbrace{\frac{g}{U^2}\sin\theta\left(\frac{\rho_w}{\rho_p} - 1\right)}_{\text{Buoyancy}} \tag{4}$$

where $C_d$ is the drag coefficient for crossflow.

Under the assumption of no slip between the liquid and vapor in the plume, the plume density is as shown in Equation 5:

$$\rho_p = f_g\rho_g + (1-f_g)\rho_w \quad (5)$$

The crossflow momentum equation permits calculation of the plume trajectory by resolving buoyancy and current forces at each position along the plume axis into axial and crossflow components, the axial component being parallel to the local plume axis and the crossflow component being normal to the local axis. The crossflow momentum of the plume is modified at each axial position by these buoyancy and current forces, resulting in a change in the plume axis direction. Integration along the plume centerline permits calculation of the plume trajectory.

Current forces on the plume are calculated by treating the plume as a cylindrical object in crossflow. The local current velocity is resolved into axial and crossflow components. The crossflow drag is calculated using high Reynolds Number profile drag relations and assuming a drag coefficient (Cd) of unity. Current is allowed to vary with water depth based on tabular values specified by the user. While treating the plume as a solid cylinder in crossflow is an approximation, it advantageously permits inclusion of current effects in a plausible manner.

Furthermore, buoyancy forces are calculated in both the axial and crossflow directions, assuming them to be vertically upward and proportional to gravitational acceleration and the local difference between the densities of the plume and the surrounding fluid. As a result, plumes having a high gas fraction, and hence a low density, usually have a greater tendency to turn upward than plumes with a high liquid fraction.

For overexpanded gas jets at the source, choked flow exists at the nozzle exit plane, and a complicated overexpansion region exists in the jet until the jet pressure falls to the pressure of the surroundings. This overexpansion region is modeled simplistically by assuming a cone downstream of the nozzle having a half angle of 15 degrees. In this overexpansion region, no entrainment or curvature is allowed. The end of the overexpansion region occurs when input mass conservation can be satisfied by a gas at sonic velocity and at a pressure and temperature matching the pressure and temperature of the local surrounding fluid. This overexpansion region tends to be short, on the order of ten nozzle diameters, as is observed in experiments. This simplified, approximate treatment avoids calculation of complicated overexpansion gas dynamics. At the end of the overexpansion region the previously described axial and crossflow mass and momentum equations are invoked.

The entrainment factor, $\alpha$, is modified by a density modification, as shown in Equation 6, below, to give a density modified entrainment factor $\alpha_m$.

$$\alpha_m = \alpha\left(\frac{\rho_p}{\rho_w}\right)^{1/2} \quad (6)$$

where $\rho_p$ is the local plume density and $\rho_w$ is the local density of the surrounding water. This modification represents a plausible way of expressing the suppression of liquid entrainment in high velocity gas jets.

From the plume centerline position, angle, and radius at any point along that centerline, the edges of the plume can be located as represented in Equations 7 to 10, below.

$$\text{Upper edge: } X = X_c - b\cos\theta \quad (7)$$

$$Y = Y_c + b\sin\theta \quad (8)$$

$$\text{Lower edge: } X = X_c + b\cos\theta \quad (9)$$

$$Y = Y_c b\sin\theta \quad (10)$$

where

X=Horizontal (lateral) distance to edge of plume

Y=Vertical distance to edge of plume $X_c$=Horizontal (lateral) distance to plume centerline $Y_c$=Vertical distance to plume centerline Integration is performed over position steps from the release point to the water surface. Output is reported as a function of distance along the plume axis. The outputs include the depth below the water surface, plume velocity, gas fraction in the plume, and plume density.

The model is applicable to releases of gas, vapor/liquid, or liquid hydrocarbons. As the plume rises, the density of the hydrocarbon mixture decreases due to the decrease in hydrostatic pressure and, if appropriate, increased vaporization of liquid hydrocarbon. The density of the hydrocarbon-water plume increases due to increased water entrainment. Because the usual interest is in releases in seawater, the effect of salinity on the density of seawater is also considered in the model.

In some embodiments:

1. A hydrocarbon processing method comprising:

processing a gaseous hydrocarbon stream to form a first production stream and a first injection stream (preferably the first injection stream is one of an acid gas stream or a sour gas stream); and compressing the first injection stream in a compressor placed at a selected location below a surface of a sea (preferably the selected location is one of the sea floor and a support structure fixedly attached to the offshore platform; preferably the selected location is at a depth of about 300 meters or greater);

wherein the location of the subsea compressor relative to a nearest inhabited area is determined based on a bubble plume trajectory of a model leak of the first injection stream from the compressor (preferably the selected location is at a horizontal distance of about 300 meters or more from the inhabited area); and wherein the bubble plume trajectory is determined using one or more crossflow momentum parameters (preferably the crossflow momentum parameter includes terms for current and/or buoyancy effects) and, optionally, one or more of the pressure of the conduit having the leak, the depth of the sea, the horizontal distance of the subsea compressor from the inhabited area, the salinity of the sea, the temperature of the water, the density of the components of the first injection stream, the velocity of the water currents, and the leak diameter.

2. The method of paragraph 1, further comprising describing the bubble plume trajectory by one or more of plume rise time (preferably the plume rise time is greater than about 2.0 minutes; preferably greater than about 10.0 minutes), waterline gas velocity (preferably the waterline gas velocity is less than about 6 meters/second; preferably less than about 3 meters/second), and waterline plume radius.

3. The method of paragraphs 1 and 2, wherein the producing and/or processing steps occur at an offshore platform.

4. A hydrocarbon processing facility useful in the hydrocarbon processing method of paragraphs 1 to 3 comprising:

a gas processing system configured to receive and process a gaseous hydrocarbon stream to produce at least one injection gas stream and at least one production gas stream;

an acid gas injection system comprising a compressor, configured to compress and inject the at least one injection gas stream (preferably one of an acid gas stream or a sour gas stream), the compressor being placed at a selected location below the surface of a sea (preferably the location is at a depth of about 300 meters or greater);

wherein the location of the subsea compressor relative to a nearest inhabited area is determined based on a bubble plume trajectory of a model leak of the first injection stream from the compressor (preferably the compressor is located at a horizontal distance of about 300 meters or more from the inhabited area); and wherein the bubble plume trajectory is determined using one or more crossflow momentum parameters (preferably the crossflow momentum parameter includes terms for current and/or buoyancy effects); and optionally, one or more of the pressure of the conduit having the leak, the depth of the sea, the horizontal distance of the subsea compressor from the inhabited area, the salinity of the sea, the temperature of the water, the density of the components of the first injection stream, the velocity of the water currents, and the leak diameter.

5. The facility of paragraph 4, wherein the bubble plume trajectory is described by one or more of plume rise time (preferably the plume rise time is greater than about 2.0 minutes, more preferably greater than about 10.0 minutes), waterline gas velocity (preferably the waterline gas velocity is less than about 6 meters/second, more preferably less than about 3 meters/second), and waterline plume radius.

6. The facility of paragraphs 4 and 5, wherein the facility comprises an offshore platform (preferably the compressor is located at a location selected from the group consisting of the sea floor and a support structure fixedly attached to the offshore platform).

7. A process for designing the integrated hydrocarbon gas processing facility of paragraphs 4 to 6, comprising:

providing an offshore production platform having an inhabited area;

providing at least one gas sweetening unit located on the offshore production platform;

wherein the at least one gas sweetening unit is in fluid communication with at least one liquid separation unit and at least one subsea compressor unit; and determining a selected location of the subsea compressor relative to a nearest inhabited area;

wherein the determination is based on a bubble plume trajectory of a model leak from the compressor (preferably the bubble plume trajectory is determined using one or more crossflow momentum parameters; preferably the crossflow momentum parameter includes terms for current and/or buoyancy effects.); and optimizing the time a leak of gas from the subsea compressor takes to reach the inhabited area.

8. The process of paragraph 7, wherein the bubble plume trajectory is described by one or more of plume rise time (preferably the plume rise time is greater than about 2.0 minutes, more preferably greater than about 10.0 minutes), waterline gas velocity (preferably the waterline gas velocity is less than about 6 meters/second, more preferably less than about 3 meters/second), and waterline plume radius.

9. The process of paragraphs 7 and 8, wherein the bubble plume trajectory is further determined by one or more of the pressure of the conduit having the leak, the depth of the sea, the horizontal distance of the subsea compressor from the inhabited area, the salinity of the sea, the temperature of the water, the density of the components of the first injection stream, the velocity of the water currents, and the leak diameter.

10. A mathematical model useful in the method of paragraphs 1 to 3, the facility of paragraphs 4 to 6, and the process of paragraph 7 to 9, for the prediction of the trajectory of subsea leaks, wherein the model predicts a bubble plume trajectory of one or more subsea leaks based on at least one or more crossflow momentum parameters (preferably the crossflow momentum parameter includes terms for current and/or buoyancy effects).

EXAMPLES

The bubble plume model described herein was used to predict various properties of an unexpected release, such as waterline gas velocity, waterline plume radius, and plume rise time. The leak modeled is a leak from an acid gas compressor located subsea, where the leak is angled upwards (the worst case scenario).

Example 1

Effect of Depth on Waterline Gas Velocity

The predictive results of increasing depth on waterline gas velocity are shown below in Table 1 and represented in FIG. 3.

TABLE 1

WATERLINE GAS VELOCITY REDUCTION WITH DEPTH

| | Equivalent Leak | Depth of Leak (ft) | | |
|---|---|---|---|---|
| | Diameter (mm) | 100 | 300 | 1000 |
| Waterline Gas | 5 | ~0 | ~0 | ~0 |
| Velocity (ft/s) | 25 | 4 | 1 | 0 |
| | 100 | 28 | 7 | 1 |

Figure 3:
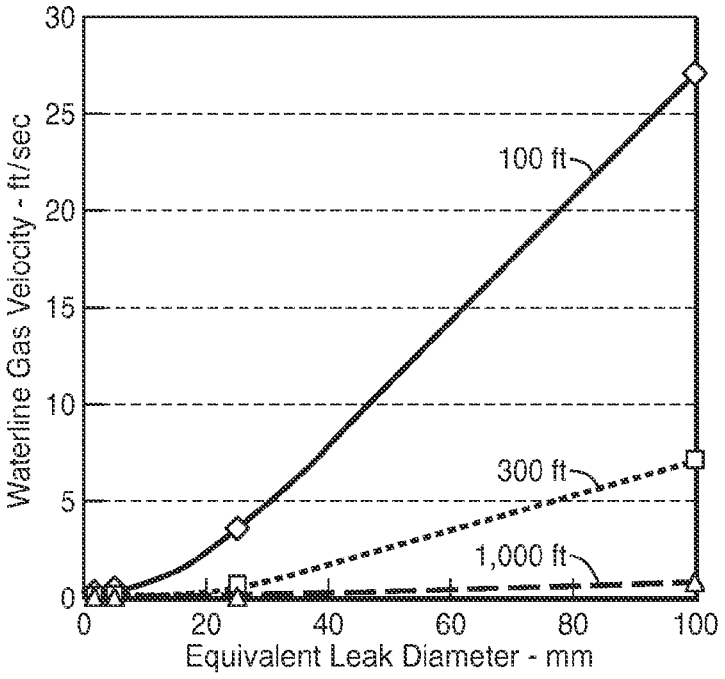
FIG. 3 shows the predicted effect of depth on the waterline gas velocity using the bubble plume model of the present disclosure.

FIG. 3 shows the effect of equivalent leak diameter and depth of leak on waterline gas velocity. FIG. 3 shows that as the depth of the leak increases, the waterline gas velocity decreases.

Example 2

Figure 4:
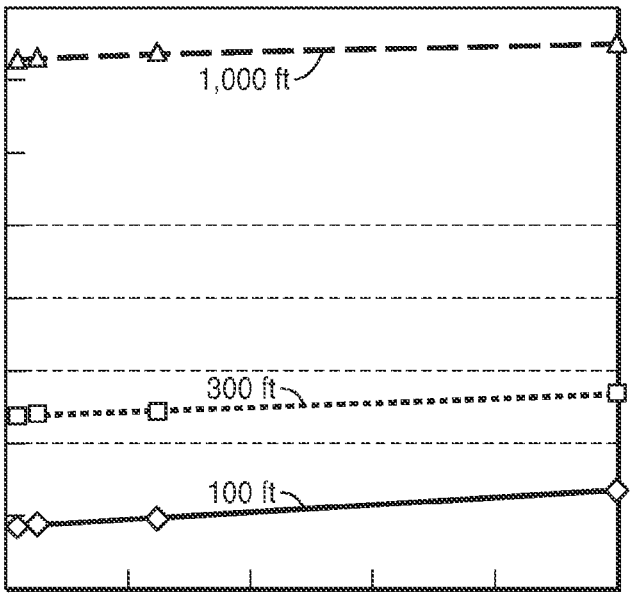
FIG. 4 shows the predicted effect of depth on waterline plume radius using the bubble plume model of the present disclosure.

Effect of Depth of Leak and Equivalent Leak Diameter on Waterline Plume Radius The predictive results of increasing depth on waterline plume radius are shown below in Table 2 and represented in FIG. 4.

TABLE 2

EFFECT OF DEPTH ON WATERLINE PLUME RADIUS

| | Equivalent Leak | Depth of Leak (ft) | | |
|---|---|---|---|---|
| | Diameter (mm) | 100 | 300 | 1000 |
| Waterline Plume | 2.5 | 9 | 24 | 72 |
| Radius (ft) | 5 | 9 | 24 | 72 |

TABLE 2-continued

| EFFECT OF DEPTH ON WATERLINE PLUME RADIUS | | | |
|---|---|---|---|
| Equivalent Leak | Depth of Leak (ft) | | |
| Diameter (mm) | 100 | 300 | 1000 |
| 25 | 10 | 25 | 73 |
| 100 | 14 | 28 | 75 |

Example 3

Effect of Depth of Leak and Equivalent Leak Diameter on Plume Rise Time

Figure 5:
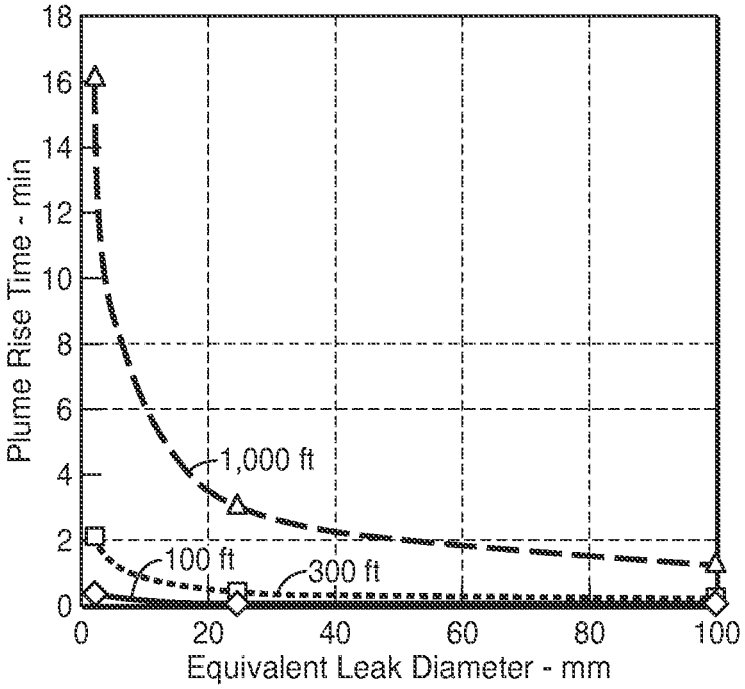
FIG. 5 shows the predicted effect of depth and equivalent leak diameter on plume rise time using the bubble plume model of the present disclosure.

The predictive results of increasing depth on plume rise time are shown below in Table 3 and represented in FIG. 5.

TABLE 3

| EFFECT OF DEPTH AND EQUIVALENT LEAK DIAMETER ON PLUME RISE TIME | | | | |
|---|---|---|---|---|
| | Equivalent Leak | Depth of Leak (ft) | | |
| | Diameter (mm) | 100 | 300 | 1000 |
| Plume Rise Time (min.) | 2.5 | 0.5 | 2.1 | 16 |
| | 5 | 0.3 | 1.2 | 8.8 |
| | 25 | ~0 | 0.5 | 3 |
| | 100 | ~0 | ~0 | 1.5 |

Examples 4-7

Effect of Gas Composition, Depth of Leak and Equivalent Leak Diameter on Waterline Gas Velocity, Waterline Plume Radius, Plume Rise Time and Atmospheric Plume Dispersion Table 4 shows the composition of gases for which the predictions are presented. Gases 1 and 2 have compositions which are typical of acid gas injection (AGI) operations, whereas Gas 3 has a composition typical of sour gas injection (SGI) operations.

TABLE 4

| COMPOSITION OF PREDICTIVE TEST GASES 1-3 | | | |
|---|---|---|---|
| | Gas 1 (AGI) | Gas 2 (AGI) | Gas 3 (SGI) |
| Composition (mol. %): | | | |
| Nitrogen ($N_2$) | 2 | 1 | 1.1 |
| Carbon dioxide ($CO_2$) | 36 | 81 | 5.1 |
| Hydrogen sulfide ($H_2S$) | 61 | 16 | 17.9 |
| Methane | 1 | 2 | 58.9 |
| Ethane | | | 9.2 |
| Propane | | | 4.5 |
| Butanes and heavier | | | 3.3 |
| Total | 100 | 100 | 100.0 |
| Pressures (psia): | | | |
| Compressor suction | 30 | 30 | 30 |
| Compressor discharge | 4000 | 4000 | 6000 |
| Temperature (° F.): | 120 | 120 | 120 |

Predictions were calculated for a leak directed upward, as shown in Examples 4-7, below.

Example 4

Figure 6A:
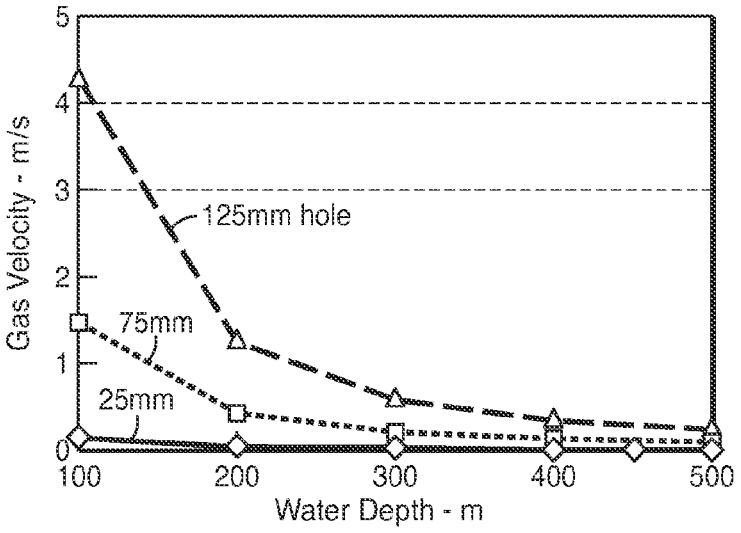
FIG. 6 shows the predicted effect of depth and equivalent leak diameter on waterline gas velocity using the bubble plume model of the present disclosure.
Figure 6B:
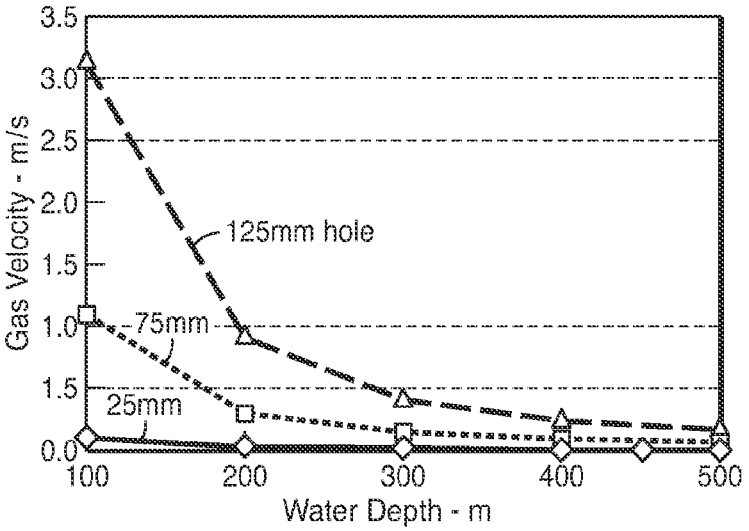
Figure 6C:
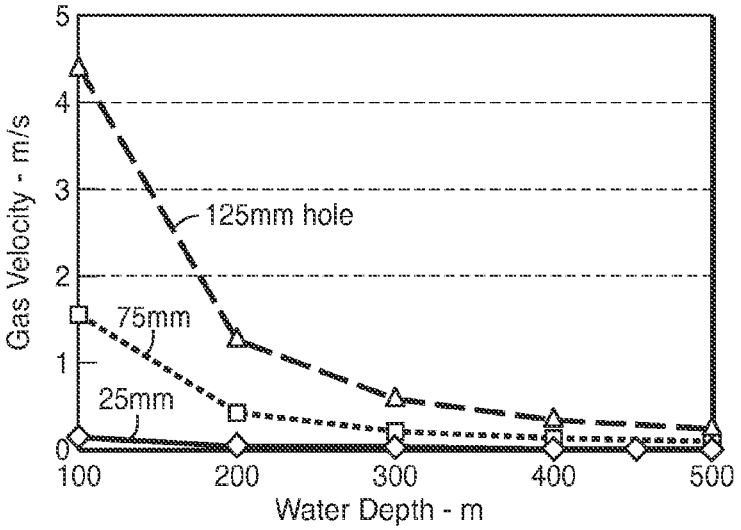

Effect of Composition, Depth of Leak and Equivalent Leak Diameter on Waterline Gas Velocity FIG. 6 shows the predicted velocity of the gas leaving the water surface (waterline gas velocity). The velocity is very low because the plume has spread out while rising through the water. In contrast, the velocity for a leak on the surface is the sonic velocity at the release point, which is about 240 m/s for the acid gases (Gases 1 & 2) and about 410 m/s for the sour gas (Gas 3).

Example 5

Figure 7A:
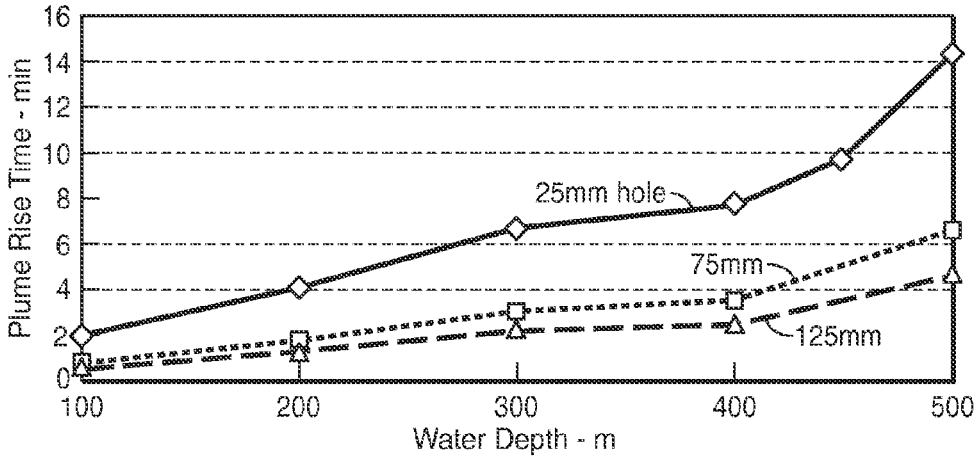
FIG. 7 shows the predicted effect of depth on plume rise time for releases of different compositions using the bubble plume model of the present disclosure.
Figure 7B:
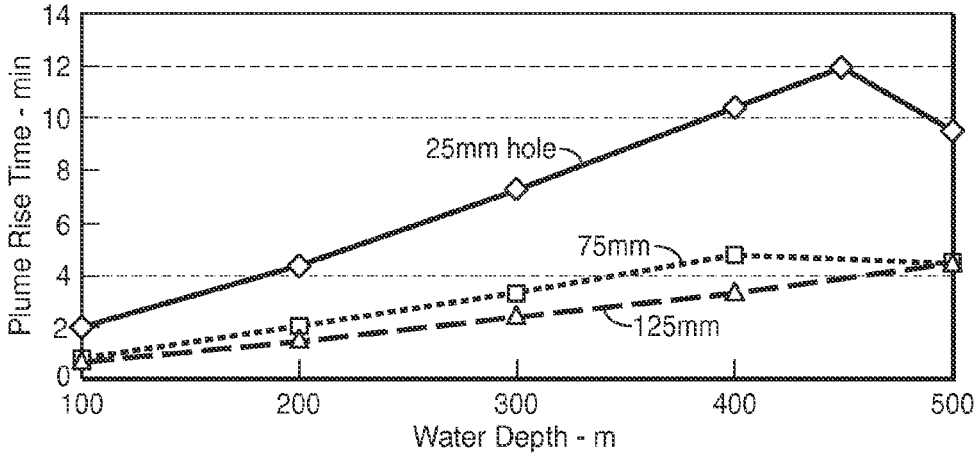
Figure 7C:
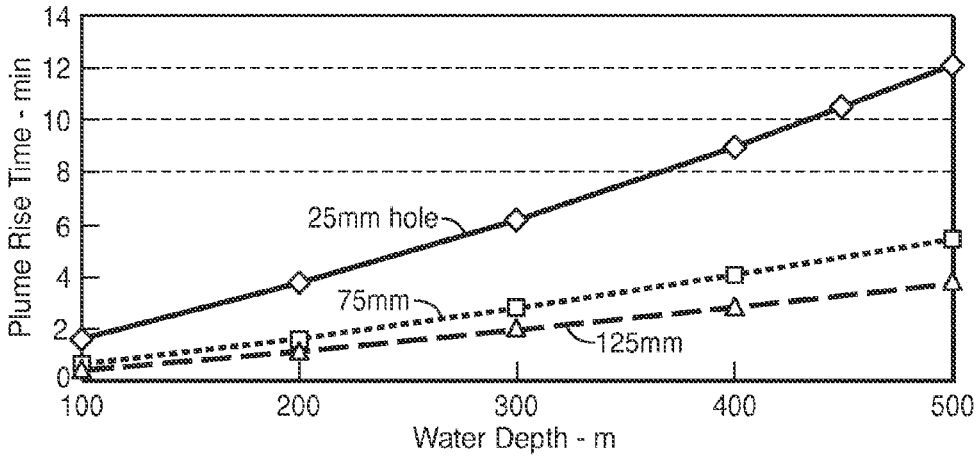

Effect of Composition, Depth of Leak and Equivalent Leak Diameter on Plume Rise Time Locating the compressor subsea provides additional time for leaks to rise to the surface. FIG. 7 shows the plume rise time as a function of the depth to which the compressor is submerged and leak diameter. This demonstrates the value of locating AGI compressors subsea by providing additional time for event response to protect personnel.

Example 6

Figure 8A:
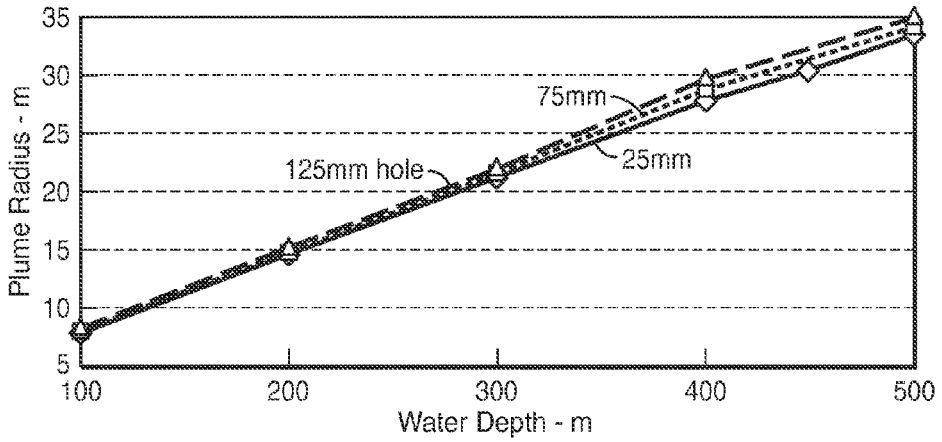
FIG. 8 shows the predicted effect of depth on waterline plume radius for releases of different compositions using the bubble plume model of the present disclosure.
Figure 8B:
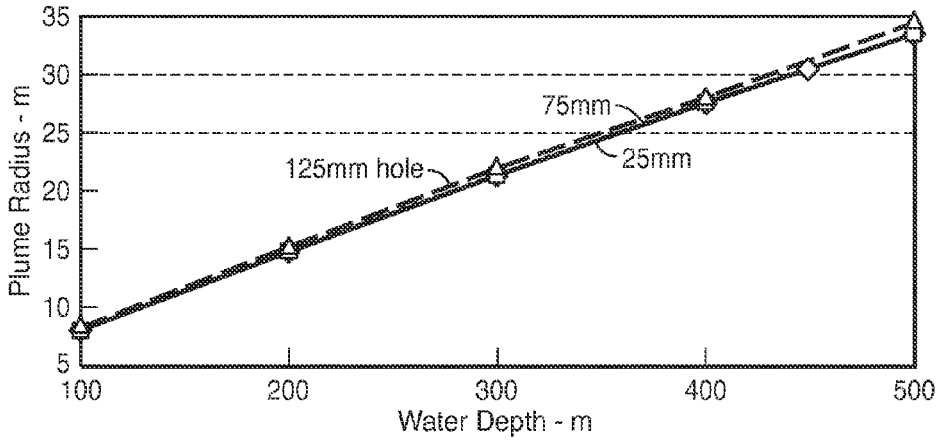
Figure 8C:
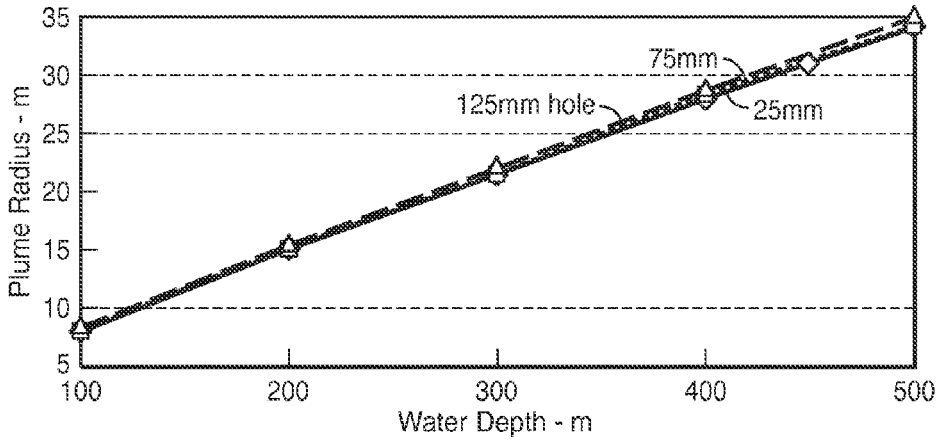

Effect of Composition, Depth of Leak and Equivalent Leak Diameter on Plume Radius at the Water Surface Distance can also reduce the risks involved with sour gas leaks. The farther the leak source from the worker population, the greater the opportunity for dispersion of the gas to a harmless level. Greater distance also increases the time required for the plume to possibly (depending on the wind direction) reach an area where personnel are, thus providing more warning time. Since real estate is quite limited offshore, it is difficult to achieve significant spacing within the facility itself. However, if the real estate is essentially extended onto the seabed, the distance can be increased dramatically at limited incremental cost. FIG. 8 shows that the plume radius at the water surface depends primarily on the depth to which the compressor is submerged.

Example 7

Effect of Depth of Leak on Atmospheric Plume Dispersion

Figure 9A:
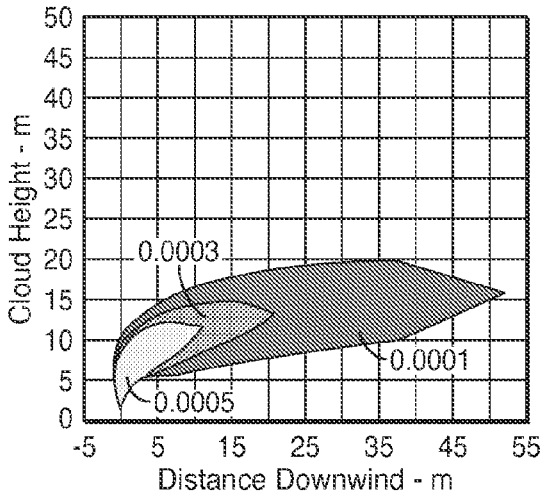
FIG. 9 shows the predicted effect of depth of leak on atmospheric plume dispersion using the bubble plume model using the bubble plume model of the present disclosure.
Figure 9B:
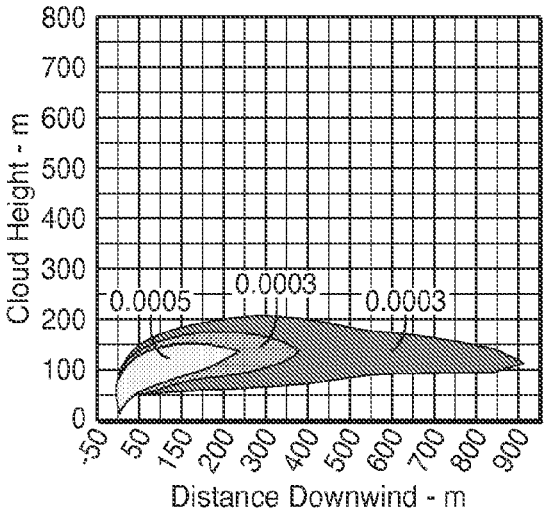
Figure 9C:
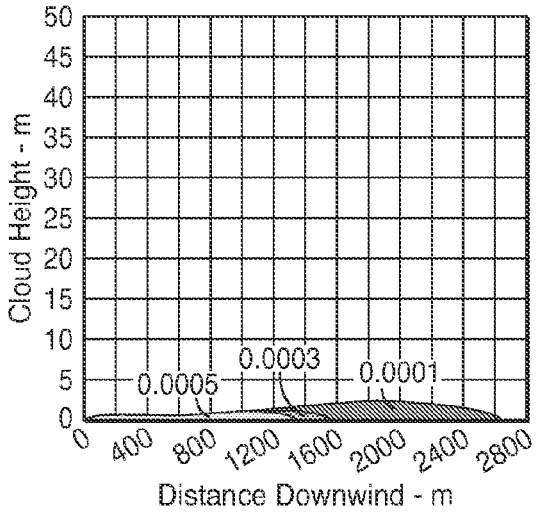

An important advantage of locating the compressor subsea is that all the surface facilities then operate at low pressure. Low pressure at the source of a surface leak means a low release rate and hence rapid dispersion into the atmosphere. FIG. 9 compares side views of the atmospheric dispersion plumes for releases of Gas 2 for three cases. Case A is a surface release from the low-pressure surface facilities, based on a typical pressure of 30 psia (the suction side of the compressor). The curves show the contours for $H_2S$ concentrations of 100, 300, and 500 ppm. For Case A the cloud is small because the release rate is low (~3 lb/s). Case B is a surface release from high-pressure facilities (the discharge side of the compressor), based on a typical pressure of 4000 psia. The cloud is large because the release rate is high (~840 lb/s). Case C is a subsea release. Here the release rate is the same as in Case B but the velocity leaving the water surface is very low, so the plume is readily swept sideways by the wind and stays close to the water surface. This is important because if the wind is toward the platform the acid/sour gas concentrations will stay below the platform and will not endanger personnel on the platform. Elimination of the hazardous high-pressure surface release (Case B) is a major benefit of this invention.

Example 8

Effect of Water Currents on Lateral Displacement of Plume

The predictions discussed above are for no current in the water. Current will lengthen the plume path and hence increase the plume rise time. It will also displace the plume laterally, which can provide additional distance separation if the current is away from the platform. As an illustration, Table 2 shows the effect of a 1 m/s current for a release of Gas 1 from a 75-mm equivalent hole.

| | Plume Rise Time (min) | | Lateral Displacement (m) | |
|---|---|---|---|---|
| Water Depth (m) | No current | 1 m/s | No current | 1 m/s |
| 200 | 1.85 | 2.00 | 0 | 121 |
| 300 | 3.13 | 3.62 | 0 | 232 |
| 400 | 3.62 | 3.87 | 0 | 226 |

Example 9

Small Scale Validation of the Model

To provide some validation of the model, a small-scale apparatus was built and 16 tests were conducted. The reservoir was a polycarbonate tank approximately 0.9 m long, 0.3 m wide, and 0.5 m deep. It was filled with water to a depth of about 0.3 m. Stainless steel tubing (½ inch diameter) was used to connect a pressure regulator, flowmeter, pressure gauge, and nozzle in series. The pressure regulator was connected to the utility compressed air system.

Nozzles of 2.36, 3.26, and 3.97 mm were made by drilling holes in Swagelok® end caps. Interchanging these caps provided variable nozzle sizes for different tests. Air flow rates were measured with a Dwyer variable area flowmeter having a maximum range of 0.28 $m^3$/hr. The measured flow rate was corrected using Equation 11:

$$Q_c = Q\left(\frac{P_g}{P_{std}}\right)^{1/2} \tag{11}$$

where $P_g$ is the measured absolute pressure downstream of the flowmeter and $P_{std}$ is the standard atmospheric pressure of 1.013 bara.

A transparent sheet having a one inch grid pattern was attached to the front of the tank to permit measurement of plume sizes and trajectories. An opaque plastic sheet was attached to the back of the tank. A video recorder and still photographs were used to document the tests. For each of the three nozzles, a range of flowrates was investigated. The air flowrate was controlled by manually adjusting the pressure regulator. A range of regulator settings was chosen to produce both choked and unchoked flow at the nozzle. Choked, under-expanded flow resulted in a more stable plume than the unchoked flows generated at lower regulator settings. A total of 16 tests were conducted. The angle of inclination of the nozzle (and hence the release) from vertical was 85 degrees for 14 of the tests and 45 degrees for the other two tests.

Superposition of the plume and the grid pattern permitted quantitative measurement of the plume trajectory and width. The trajectory was described by X, Y coordinates, where X and Y are the horizontal and vertical distances, respectively, from the nozzle. The plume centerline and edges were defined manually.

Regardless of the nozzle diameter, higher flow rates appeared to result in greater horizontal displacement and greater plume radius. The variable entrainment factor defined by Equation 6 appeared to improve the agreement between the simulation and the data, and hence was adopted for the model. For the smallest nozzle, the variable entrainment factor substantially improved the agreement for trajectories and had little effect on the plume radius. In contrast, for the larger two nozzles the variable entrainment factor appeared to have little impact on the trajectories but improved the agreement for radii. However, in no case did the variable entrainment factor worsen the agreement.

Figure 10:
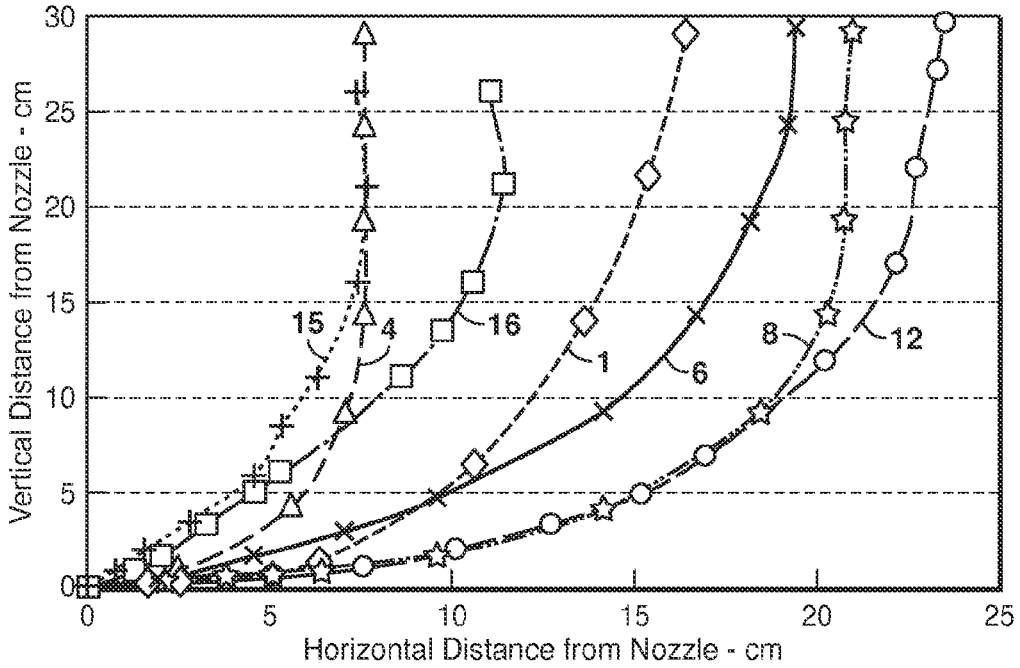
FIG. 10 shows the plume centerline trajectory for small scale test releases.
Figure 11:
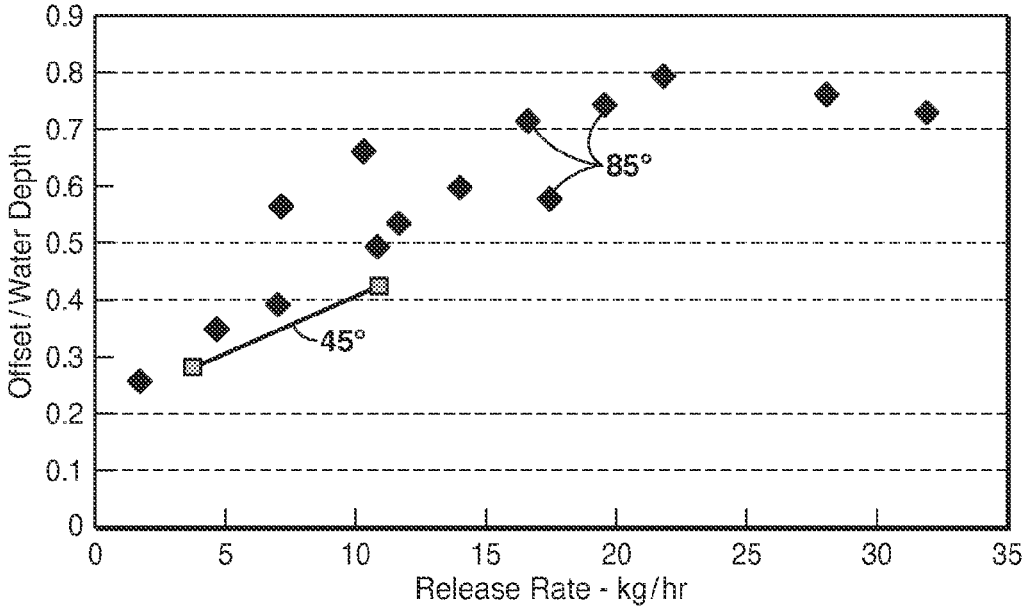
FIG. 11 shows plume offsets at the waterline as a function of the release rates for small scale test release.
Figure 12:
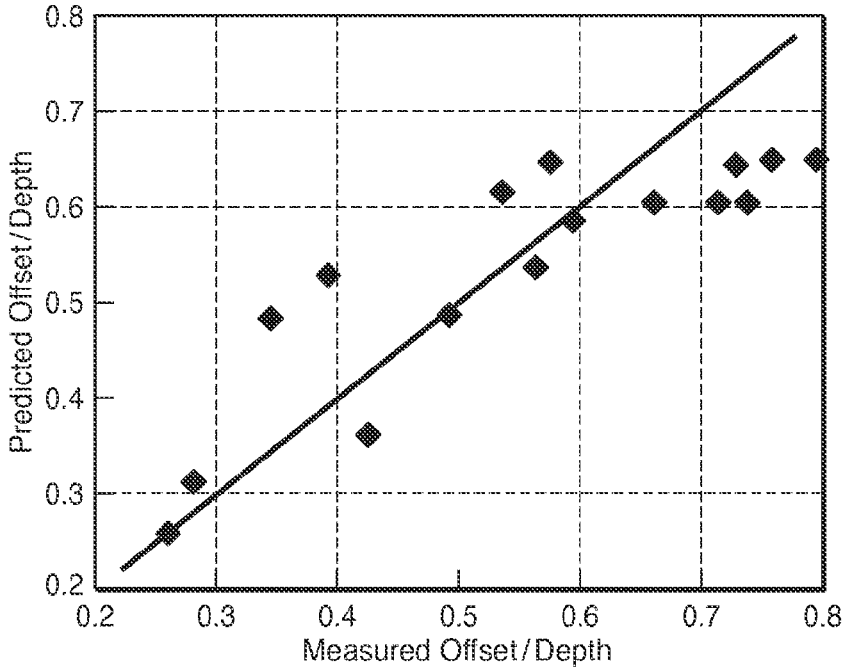
FIG. 12 shows a comparison between the measured plume offsets and the predicted plume offsets.

FIG. 10 shows the plume centerline trajectories for some of the tests. FIG. 11 shows the plume offsets at the water surface, normalized by the water depth, as a function of release rate. There is an upward trend at the lower release rates and at this shallow water depth. FIG. 12 compares the measured plume offsets, again normalized by the water depth, at the water surface, with the predictions. The agreement is generally good. The two points with the smallest offsets are for the experiments with the 45 degree release angle.

Example 10

Predictive Plumes Using Sample Gas and Oils

Figure 13:
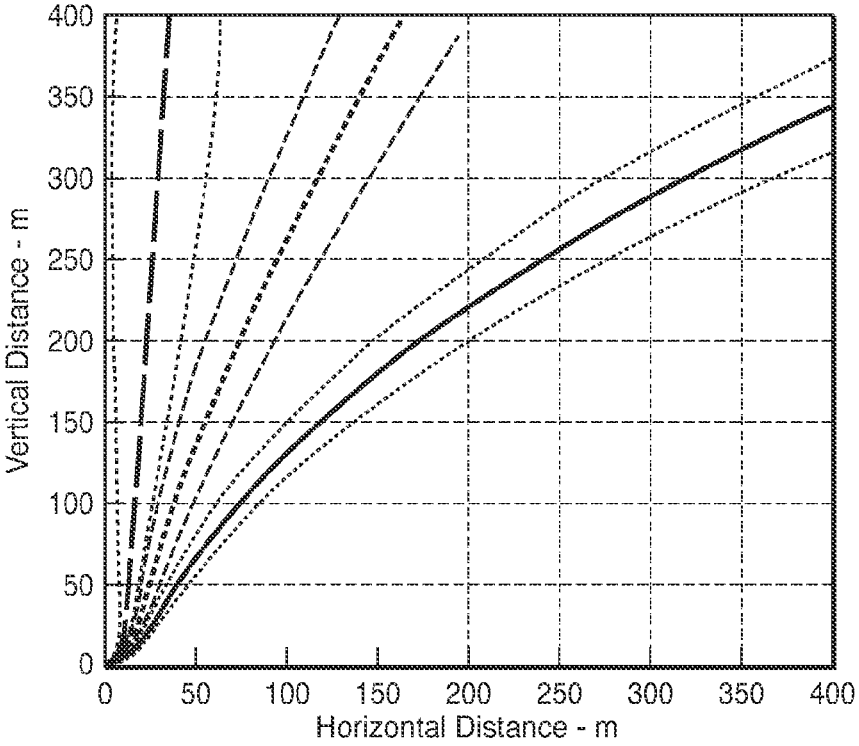
FIG. 13 shows a side view of predicted plume trajectories for three release fluids of different compositions.

FIG. 13 shows the predicted plumes for the following three fluids:

| | Gas | Live Oil | Dead Oil |
|---|---|---|---|
| Molecular weight (kg/kgmol) | 19.048 | 175.476 | 202.018 |
| Mole %: | | | |
| C1 | 82.97 | 33.82 | 0.05 |
| C2-C5 | 15.31 | 6.51 | 12.54 |
| C6-C10 | 0.005 | 20.89 | 42.40 |
| C11+ | 0 | 38.32 | 44.98 |
| Mol. Wt. of C10+ (kg/kgmol) | — | 311 | 286 |

In all cases, the fluid at stagnation conditions is at 30° C. and 140 bara. Conditions at the release point were determined from a release model, and vary for the three fluids. They are based on isentropic expansion from stagnation conditions to the release point. 40 kg/s of fluid is released horizontally under 400 m of seawater having a salinity of 3.5 wt %. The water temperature is 20° C. at the water surface and 8° C. at the release location. The current is uniformly 0.2 m/s.

FIG. 13 is a side view of the plumes, with vertical distance on the ordinate and horizontal distance on the abscissa. The release is directed to the right, and the current is to the right. The solid line represents the plume centerline and the dashed lines the edges of the plume. As the fluid moves away from the release point, its velocity decreases very rapidly. The plumes rapidly turn upward due to the buoyancy; the lighter the fluid the more rapid the upward turn. The heavier the fluid, the more it is transported by the current. The plume centerline for the heaviest fluid is S-shaped due to the combined effects of buoyancy and current. If the release orientation is non-vertical and/or there is current, the plume at the water surface will be displaced horizontally from the release location and will have an elliptical shape, since the plume trajectory will not generally intersect the water surface at a right angle. Predicted results at the water surface are as follows:

| | Gas | Live Oil | Dead Oil |
|---|---|---|---|
| Centerline displacement (m) | 36 | 165 | 507 |
| Plume area (m2) | 2475 | 3788 | 6167 |
| Plume radius (m) | 28.1 | 32.9 | 29.3 |
| Plume diameter/water depth | 0.140 | 0.165 | 0.146 |

All documents described herein are incorporated by reference herein, including any priority documents and/or testing procedures to the extent they are not inconsistent with this text, provided however that any priority document not named in the initially filed application or filing documents is NOT incorporated by reference herein. As is apparent from the foregoing general description and the specific embodiments, while forms of the invention have been illustrated and described, various modifications can be made without departing from the spirit and scope of the invention. Accordingly, it is not intended that the invention be limited thereby. Likewise, the term "comprising" is considered synonymous with the term "including" for purposes of Australian law.

We claim:

1. A hydrocarbon processing method comprising:

processing a gaseous hydrocarbon stream to form a first production stream and a first injection stream; and compressing the first injection stream in a compressor placed at a selected location below a surface of a sea;

wherein the location of the subsea compressor relative to a nearest inhabited area is determined based on a bubble plume trajectory of a model leak of the first injection stream from the compressor; and wherein the bubble plume trajectory is determined using one or more crossflow momentum parameters.

2. The method of claim 1, wherein the crossflow momentum parameter includes terms for current and/or buoyancy effects.

3. The method of claim 1, further comprising describing the bubble plume trajectory by one or more of plume rise time, waterline gas velocity, and waterline plume radius.

4. The method of claim 1, wherein the bubble plume trajectory is further determined by one or more of the pressure of the conduit having the leak, the depth of the sea, the horizontal distance of the subsea compressor from the inhabited area, the salinity of the sea, the temperature of the water, the density of the components of the first injection stream, the velocity of the water currents, and the leak diameter.

5. The method of claim 1, wherein the first injection stream is one of an acid gas stream or a sour gas stream.

6. The method of claim 1, wherein the compressor is located at a depth of about 300 meters or greater.

7. The method of claim 1, wherein a leak of the first injection stream from the compressor has a waterline gas velocity of less than about 6 meters/second.

8. The method of claim 1, wherein a leak of the first injection stream from the compressor has a waterline gas velocity of less than about 3 meters/second.

9. The method of claim 1, wherein a leak of the first injection stream from the compressor has a plume rise time of greater than about 2.0 minutes.

10. The method of claim 1, wherein a leak of the first injection stream from the compressor has a plume rise time of greater than about 10.0 minutes.

11. The method of claim 1, wherein the producing and/or processing steps occur at an offshore platform.

12. The method of claim 10, wherein the subsea compressor is located at one of the sea floor and a support structure fixedly attached to the offshore platform.

13. The method of claim 1, wherein the subsea compressor is located at a horizontal distance of about 300 meters or more from the inhabited area.

14. A hydrocarbon processing facility comprising:

a gas processing system configured to receive and process a gaseous hydrocarbon stream to produce at least one injection gas stream and at least one production gas stream;

an acid gas injection system comprising a compressor, configured to compress and inject the at least one injection gas stream, the compressor being placed at a selected location below the surface of a sea, wherein the location of the subsea compressor relative to a nearest inhabited area is determined based on a bubble plume trajectory of a model leak of the at least one injection stream from the compressor; and wherein the bubble plume trajectory is determined using one or more crossflow momentum parameters.

15. The facility of claim 14, wherein the crossflow momentum parameter includes terms for current and/or buoyancy effects.

16. The facility of claim 14, wherein the bubble plume trajectory is described by one or more of plume rise time, waterline gas velocity, and waterline plume radius.

17. The facility of claim 14, wherein the bubble plume trajectory is further determined by one or more of the pressure of the conduit having the leak, the depth of the sea, the horizontal distance of the subsea compressor from the inhabited area, the salinity of the sea, the temperature of the water, the density of the components of the at least one injection stream, the velocity of the water currents, and the leak diameter.

18. The facility of claim 14, wherein the at least one injection stream is one of an acid gas stream or a sour gas stream.

19. The facility of claim 14, wherein the compressor is located at a depth of about 300 meters or greater.

20. The facility of claim 14, wherein a leak of the at least one injection stream from the compressor has a waterline gas velocity of less than about 6 meters/second.

21. The facility of claim 14, wherein a leak of the at least one injection stream from the compressor has a waterline gas velocity of less than about 3 meters/second.

22. The facility of claim 14, wherein a leak of the at least one injection stream from the compressor has a plume rise time of greater than about 2.0 minutes.

23. The facility of claim 14, wherein a leak of the at least one injection stream from the compressor has a plume rise time of greater than about 10.0 minutes.

24. The facility of claim 14, wherein the facility comprises an offshore platform.

25. The facility of claim 24, wherein the compressor is located at a location selected from the group consisting of the sea floor and a support structure fixedly attached to the offshore platform.

26. The facility of claim 14, wherein the compressor is located at a horizontal distance of about 300 meters or more from the inhabited area.

27. A process for designing an integrated hydrocarbon gas processing facility, the process comprising:

providing an offshore production platform having an inhabited area;

providing at least one gas sweetening unit located on the offshore production platform;

wherein the at least one gas sweetening unit is in fluid communication with at least one liquid separation unit and at least one subsea compressor unit; and determining a selected location of the subsea compressor relative to a nearest inhabited area;

wherein the determination is based on a bubble plume trajectory of a model leak from the compressor; and optimizing the time a leak of gas from the subsea compressor takes to reach the inhabited area.

28. The process of claim 27, wherein the bubble plume trajectory is determined using one or more crossflow momentum parameters.

29. The process of claim 28, wherein the crossflow momentum parameter includes terms for current and/or buoyancy effects.

30. The process of claim 27, wherein the bubble plume trajectory is described by one or more of plume rise time, waterline gas velocity, and waterline plume radius.

31. The process of claim 27, wherein the bubble plume trajectory is further determined by one or more of the pressure of the conduit having the leak, the depth of the sea, the horizontal distance of the subsea compressor from the inhabited area, the salinity of the sea, the temperature of the water, the density of the components of a first injection stream, the velocity of the water currents, and the leak diameter.

* * * * *